US006510806B1

(12) United States Patent
Krieck

(10) Patent No.: US 6,510,806 B1
(45) Date of Patent: Jan. 28, 2003

(54) COVERING FOR BLINDS

(76) Inventor: Christina Krieck, 634 Fairview Ave., Piscataway, NJ (US) 08854-2712

( * ) Notice: Subject to any disclaimer, the term of this patent is extended or adjusted under 35 U.S.C. 154(b) by 0 days.

(21) Appl. No.: 09/546,127

(22) Filed: Apr. 10, 2000

(51) Int. Cl.[7] ..... D05B 35/02
(52) U.S. Cl. ..... 112/475.08
(58) Field of Search ..... 112/475.06, 475.08, 112/475.09, 475.14, 475.01, 470.33, 63, 441; 160/116.1, 230, 236

(56) References Cited

U.S. PATENT DOCUMENTS

| | | | | |
|---|---|---|---|---|
| 2,828,816 A | * | 4/1958 | Nestor | |
| 4,049,038 A | | 9/1977 | Hyman et al. | 160/166 |
| 4,475,579 A | | 10/1984 | Bassett | 160/178 |
| 4,545,833 A | * | 10/1985 | Tafara | 112/475.08 X |
| 4,773,958 A | | 9/1988 | Goodman | 156/313 |
| 4,842,036 A | | 6/1989 | Goodman | 160/166.1 |
| 4,911,220 A | | 3/1990 | Hiller | 160/236 |
| 5,012,552 A | | 5/1991 | Wulf | 16/87.4 |
| 5,017,239 A | | 5/1991 | Morrison | 134/15 |
| 5,101,876 A | | 4/1992 | Zak | 160/236 |
| 5,271,447 A | | 12/1993 | Aronovich | 160/236 |
| 5,303,760 A | | 4/1994 | Perez | 160/236 |
| 5,358,024 A | | 10/1994 | Schwaegerle | 160/236 |
| D369,264 S | | 4/1996 | Suh | 577/575 |
| 5,572,831 A | | 11/1996 | Rafiqui | 49/403 |
| 5,591,005 A | * | 1/1997 | McCready | 112/475.08 X |
| 5,598,880 A | | 2/1997 | Cross | 160/38 |
| 5,715,883 A | | 2/1998 | Keith | 160/168.1 V |
| 5,718,273 A | | 2/1998 | Best et al. | 160/166.1 |
| 5,775,399 A | | 7/1998 | Shields, Jr. | 160/176 |
| 5,937,927 A | | 8/1999 | Keith | 160/89 |

FOREIGN PATENT DOCUMENTS

| | | |
|---|---|---|
| WO | 9114071 | 9/1991 |

* cited by examiner

*Primary Examiner*—Ismael Izaguirre
(74) *Attorney, Agent, or Firm*—Walter J. Tencea, Jr.

(57) ABSTRACT

A detachable cover for a window blind is disclosed. The detachable cover can be a sleeve which may be attached by a first attachment device such as velcro to a second attachment device of a vertical window blind which may also have velcro. The sleeve may have a top, bottom, and two sides and may have an opening at the top for sliding onto the blind and may be substantially closed at the bottom and two sides. The first attachment device on the sleeve may be a ring of material located near the top of the sleeve. The second attachment device may also be an elongated strip fixed to the vertical blind so that the elongated strip runs from about the top of the vertical blind to about the bottom of the vertical blind and lies substantially in the middle of the vertical blind. A method is also disclosed of fixing a first attachment device to a substantially rectangular piece of material, folding the rectangular piece of material, so that a first portion of the rectangular piece of material lies on top of a second portion of the rectangular piece of material, sewing along a plurality of lines to connect the first portion of the rectangular piece of material to the second portion of the rectangular piece of material at a plurality of locations, and cutting the rectangular piece of material in between the sewed lines two form a plurality of sleeves.

19 Claims, 10 Drawing Sheets

COVERING FOR BLINDS

FIELD OF THE INVENTION

This invention relates to improved methods and apparatus for providing covers for blinds such as vertical blinds.

BACKGROUND OF THE INVENTION

Methods and apparatus for generally covering louvers are known in the art. For example, U.S. Pat. No. 4,911,220 to Hiller discloses a "Replaceable Decorative Louver Covering System". However each louver 14 needs to be removed from its suspension device (such as support system 27) in order to place the tubular cover 10 on the louver. See FIG. 1. Hiller discloses elongate bands 22 which extend over the top of the louver 14 in order to fix the cover 10 to the louver 14. There is no attachment device on the louver 14 itself. The elongate bands 22 connect substantially downwards from the slot 28 on the louver 14 which may give a poor aesthetic appearance. (FIG. 1).

There is a need for better louver (or blind) coverings and methods of attachment, which can be more easily attached and whose attachment can be largely hidden to give a more uniform appearance.

SUMMARY OF THE INVENTION

The present invention in one embodiment comprises a cover for covering a window blind. A first attachment device can be fixed to the cover, the first attachment device adaptable for attaching to a second attachment device located on a window blind to cause the cover to become attached to the window blind and to cause the cover to substantially cover the window blind. The first attachment device can be detachable from the second attachment device; to remove the cover from the window blind.

The cover can be shaped substantially in the form of a sleeve having a top, bottom and two sides. The window blind can be a vertical window blind. The sleeve can be substantially closed on the bottom and on the two sides and having an opening at the top.

The first attachment device on the sleeve can be a ring of material which may be located near the top of the sleeve. The first attachment device can be comprised of a first portion of a VELCRO™ system and the second attachment device on the vertical blind can be comprised of a second portion of a VELCRO™ system, where the first and second portions of the VELCRO™ system when pressed together attach the sleeve to the vertical window blind. The vertical window blind can be substantially rectangular having a top, a bottom and two sides, the top being where the vertical blind connects to a suspension device, such as a curtain rod. The second attachment device can be fixed to the vertical window blind near the top of the vertical window blind.

In another embodiment the cover can be substantially in the form of a rectangular material having a top, bottom, and two sides. The first attachment device can be comprised of first and second portions, the first portion fixed to the cover near its first side and the second portion fixed to the cover near its second side. The first portion and the second portion of the first attachment device in this embodiment can make up a first part of a VELCRO™ system and the second attachment device on the blind can make up a second part of a VELCRO™ system, where the first and second parts of the VELCRO™ system when pressed together attach the cover to the blind. The second attachment device in this embodiment can be an elongated strip fixed to the vertical blind so that the elongated strip runs from about the top of the vertical blind to about the bottom of the vertical blind and lies substantially in the middle of the vertical blind.

A method is also provided comprised of the steps of fixing a first attachment device to a substantially rectangular piece of material, folding the rectangular piece of material, so that a first portion of the rectangular piece of material lies on top of a second portion of the rectangular piece of material; sewing along a plurality of lines to connect the first portion of the rectangular piece of material to the second portion of the rectangular piece of material at a plurality of locations; and cutting the rectangular piece of material in between the sewed lines two form a plurality of sleeves. Each sleeve may be of a form and may be attached to a blind as previously described in other embodiments.

DETAILED DESCRIPTION OF THE DRAWINGS

Figure 1:
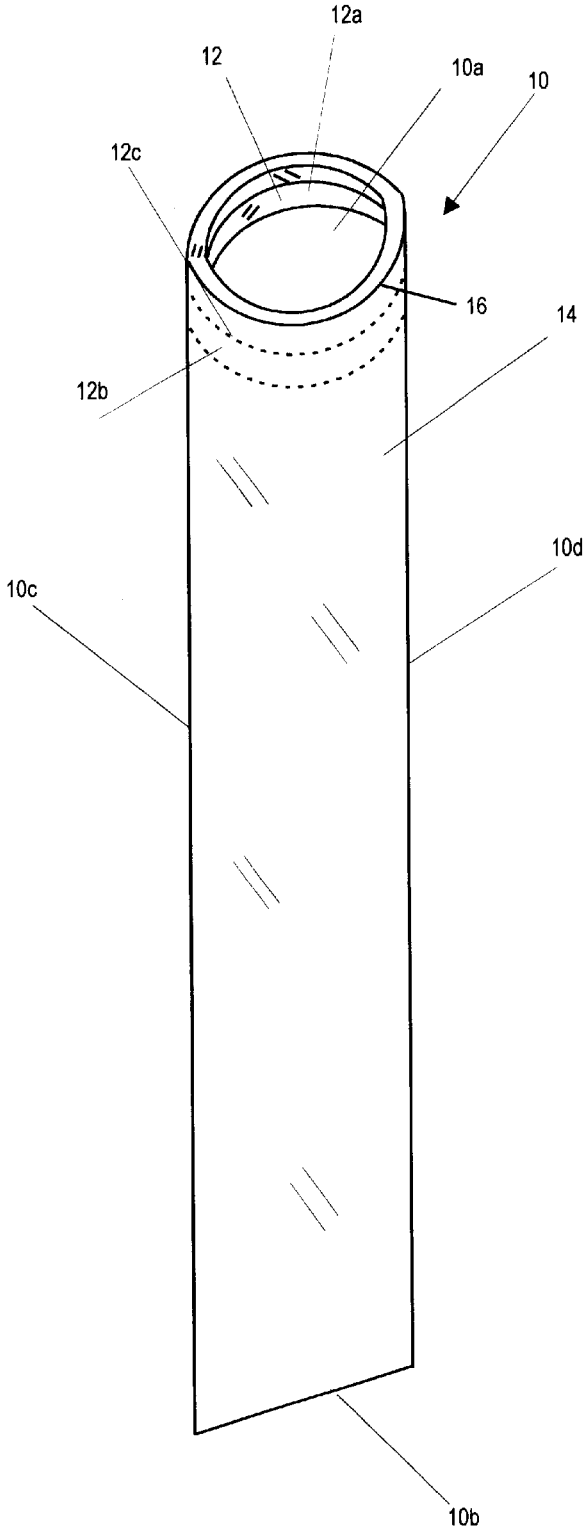
FIG. 1 shows a perspective view of a sleeve for a vertical blind in accordance with a first embodiment of the present invention.

FIG. 1 shows a perspective view of a sleeve 10 for a vertical blind in accordance with a first embodiment of the present invention.

The sleeve 10 in FIG. 1 is open at an end 10*a*, and closed at its other ends 10*b*, 10*c*, and 10*d*. The opening at end 10*a* allows the sleeve to be slipped onto a vertical blind, such as blind 100, as shown by FIG. 3B. The sleeve 10 includes a circular VELCRO™ ring 12. VELCRO™ as used in the present application may refer to either the hooks or matching loops that make up a VELCRO™ system. For example circular VELCRO ™ ring 12 may be comprised of only of "hooks" which attach to "loops" 112 on the vertical blind shown in FIG. 3A. The VELCRO™ ring is shown comprised of visible portion 12*a* and portion 12*b*, which is shown in dashed lines because it would not be visible in the perspective view of FIG. 1. The VELCRO™ ring 12 is attached to the material 14 of the sleeve 10. The VELCRO™ ring is attached inside of the sleeve 10 and cannot be seen from the outside of the sleeve 10 unless one looks through the opening 12*a*, unless the material 14 of the sleeve 10 is transparent.

The circular VELCRO™ ring 12 can be located close to a top edge 16 of the sleeve 10. A top edge 12*c* of the circular VELCRO™ ring 12 may coincide or nearly coincide with the top edge 16 of the sleeve 10, however one should not be able to see the top edge 12*c* of the circular VELCRO™ ring 12 one viewing the sleeve 10 as in FIG. 3B.

Figure 2:
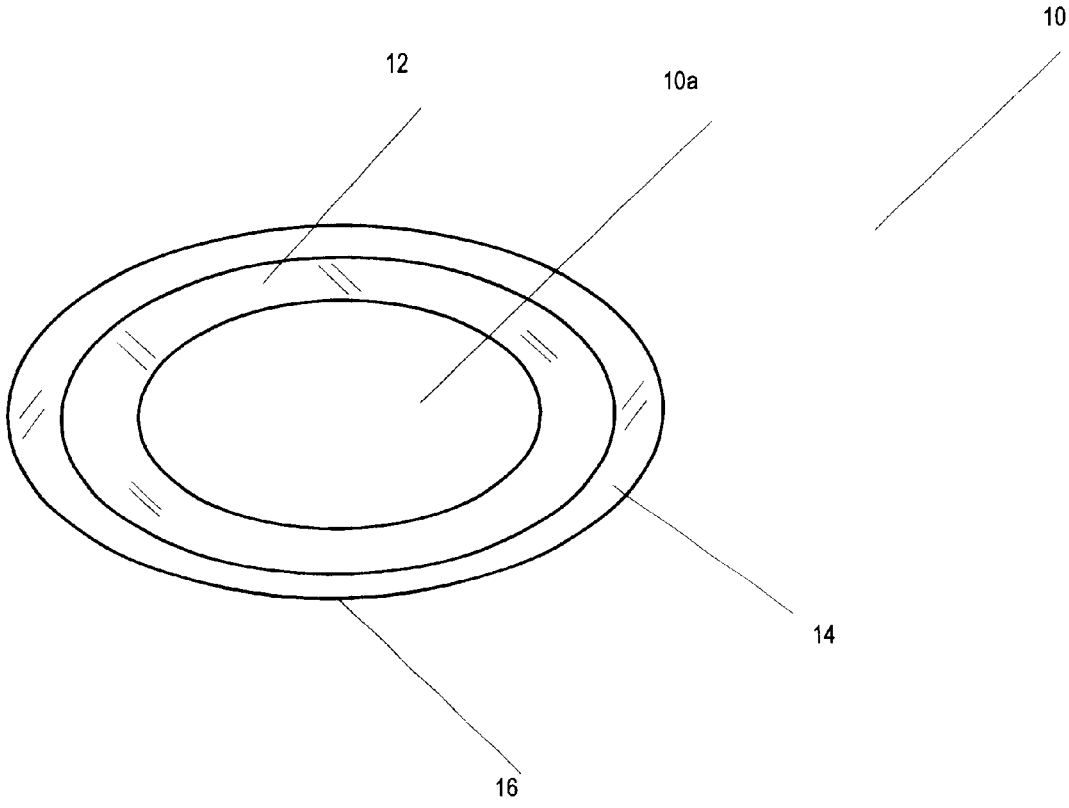
FIG. 2 shows a top view of the sleeve of FIG. 1.

FIG. 2 shows the sleeve material 14 and the VELCRO™ ring 12 from a top view.

Figure 3A:
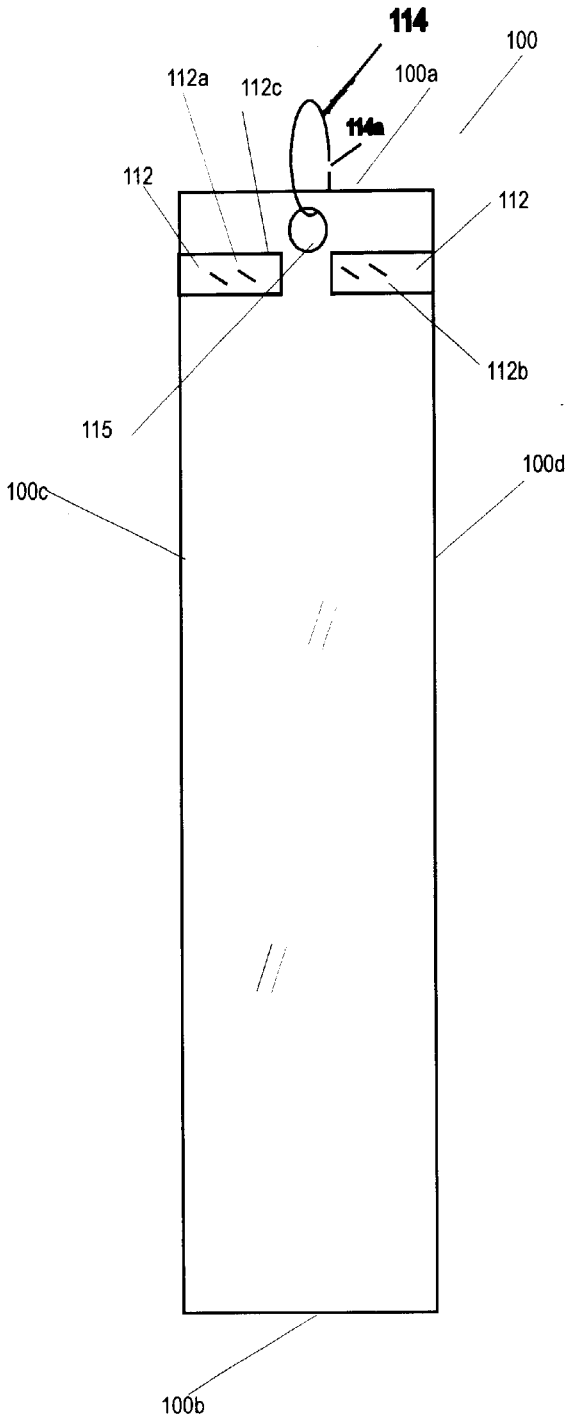
FIG. 3A shows front view of a vertical blind.
Figure 3B:
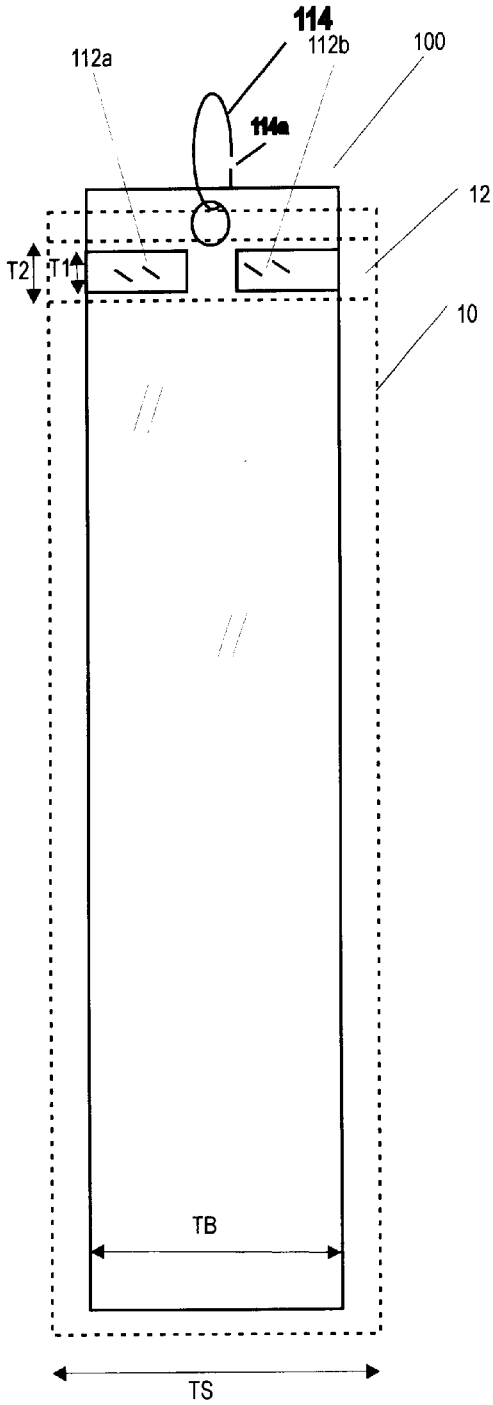
FIG. 3B shows a front view of the vertical blind of FIG. 3A with a front view of the sleeve of FIG. 1 shown in dashed lines.

FIG. 3A shows front view of a vertical blind 100. The vertical blind has VELCRO ™ strips 112 comprised of portions 112*a* and 112*b* fixed near its top edge 100*a*. A top edge 112*c* of the VELCRO™ strips can be lower than the bottom of a ring 114, when the ring 114 is holding the vertical blind 100 up. This allows the sleeve 10 to attach to the vertical blind 100 without the ring 114 getting in the way. The ring 114 may have a gap 114*a* which allows the ring to fit through a hole 115 in the vertical blind. The ring 114 may be replaced by a hook or any other device for attaching blinds to a blind suspension apparatus.

FIG. 3B shows a front view of the vertical blind 100 of FIG. 3A with a front view of the sleeve of 10 of FIG. 1 shown in dashed lines. The vertical blind 100 may have a width TB which may be about the same as the width TS of the sleeve 10 when it covers the blind as shown in FIG. 3B and lies flat. TS would need to be a little larger than TB however, there should be a snug fit, so there isn't a baggy appearance. The strip of VELCRO™ 12 on the sleeve 10 may have a width T2 which may be about the same as the width T1 of the strip of velcro 112 (112*a* and 112*b*) on the vertical blind 100.

Figure 4:
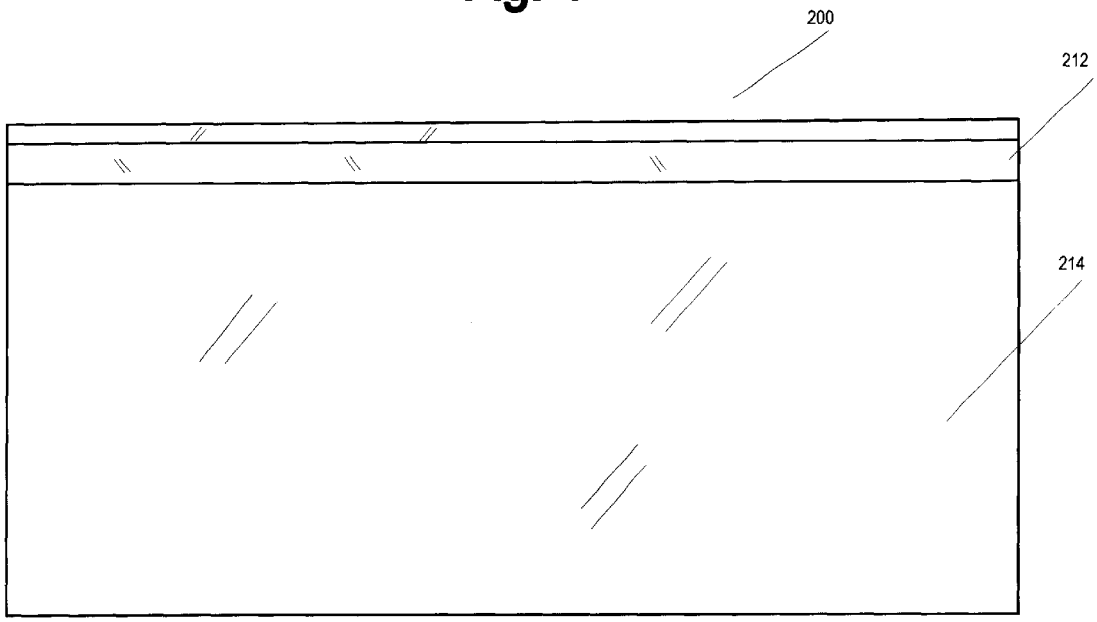
FIG. 4 shows length of material for producing sleeves is accordance with an embodiment of the present invention.

FIG. 4 shows length of material including VELCRO™ 200 (or again half of a VELCRO™ system) for producing sleeves is accordance with an embodiment of the present invention. The material including velcro 200 is comprised of VELCRO™ portion strip 212 and material 214. (The VELCRO™ portion strip 212 is fixed onto the material 214 by sewing. The material 214 can be any fabric suitable or desired, however a fire retardant, washable, and shrink resistant fabric is preferred.

Figure 5:
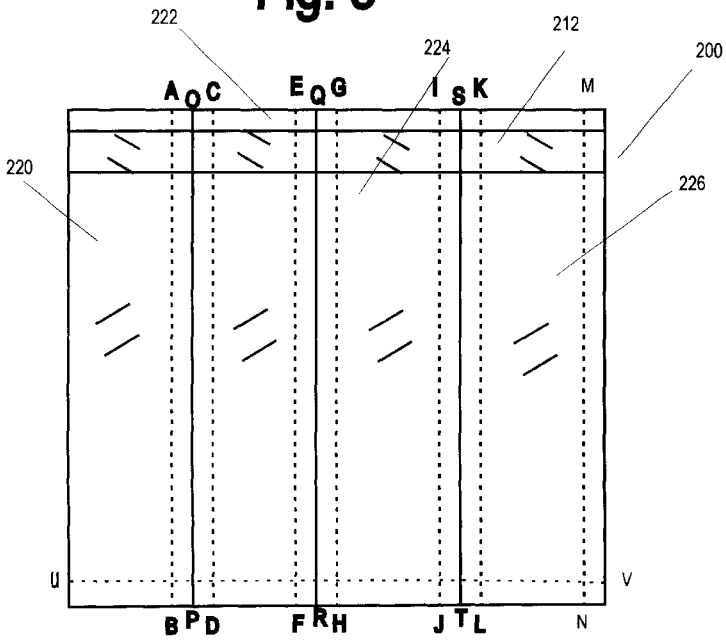
FIG. 5 shows the length of material of FIG. 4 folded over.

FIG. 5 shows the length of material including VELCRO™ 200 of FIG. 4 folded over. In FIG. 5 the length of material including VELCRO™ portion 200 can be folded over so that the VELCRO™ portion 212 is not covered but rather visible. After the material including VELCRO™ portion 200 is folded over the material including VELCRO™ portion 200 is sewn together along vertical lines AB, CD, EF, GH, IJ, KL, and MN. The material including VELCRO™ portion 200 is also sewn together along horizontal line UV. The material including VELCRO™ portion 200 is then cut along lines OP, QR, and ST. This results in the creation of tubelike sleeves 220, 222, 224, and 226. The tube like sleeves are then turned inside out so that the sewing seems (along lines AB, CD, EF, GH, IJ, and KL) cannot be seen and so that the parts of VELCRO™ portion 212 are now inside the tubelike sleeves and also cannot be seen. The tube like sleeves 220, 222, 224, and 226 then have the characteristics and basic appearance of the sleeve 10 in FIG. 1.

Figure 6:
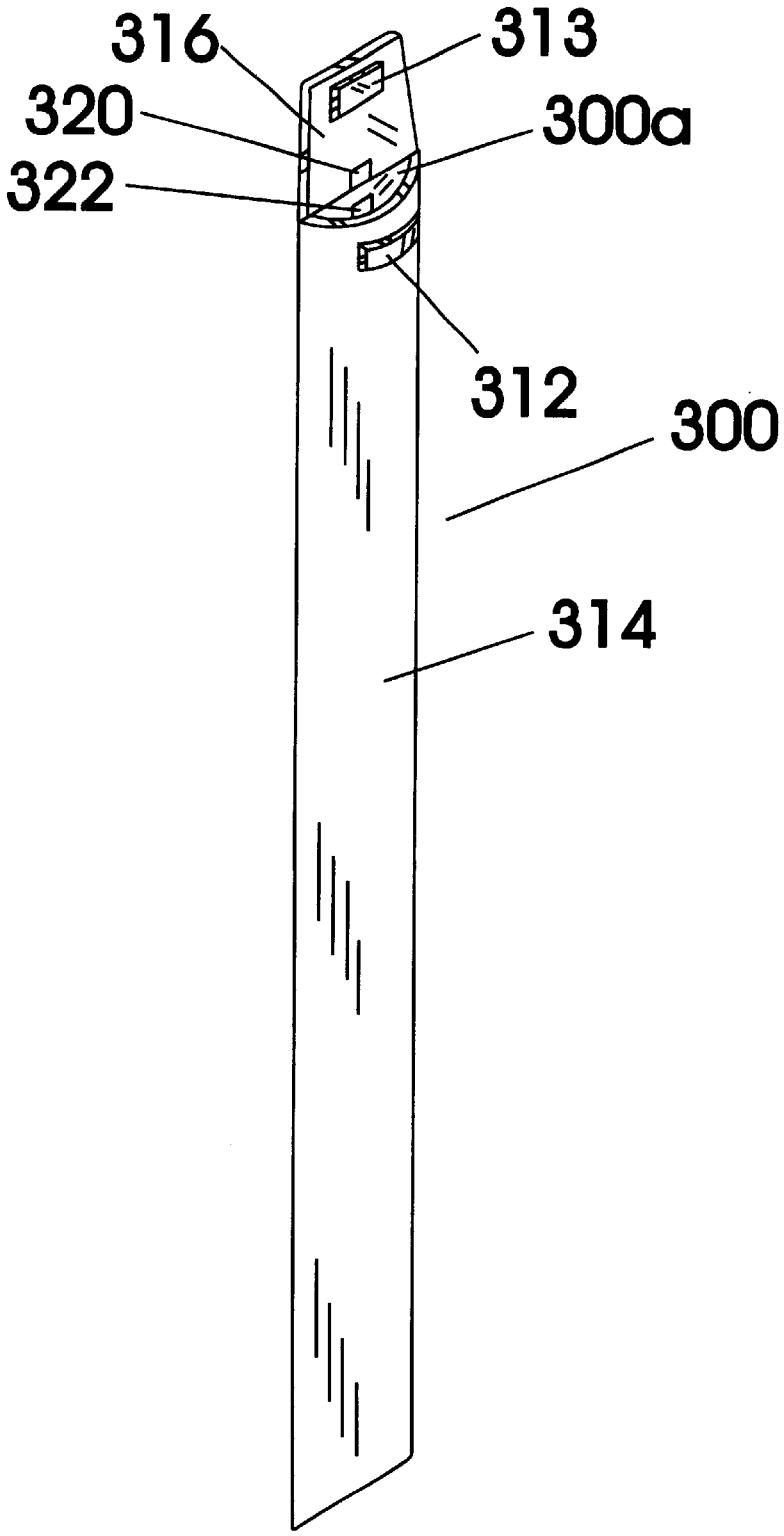
FIG. 6 shows another embodiment of a sleeve in accordance with the present invention.

FIG. 6 shows another embodiment of a sleeve, sleeve 300, in accordance with the present invention. Sleeve 300 has a material 314 onto which is fixed a VELCRO™ strip 312 (or again half of a VELCRO™ system, "hooks" or "loops"). The other half of the VELCRO™ system, VELCRO™ strip 313 is attached to an extension 316. The sleeve 300 can be made to cover a blind such as blind 100 of FIG. 3A, by inserting the bottom edge 100*b* into the opening 300*a* and sliding the sleeve 300 up the blind 100. However, the ring 114 is typically connected to a rod or some other mounting device, and typically the blind 100 would need to be taken off that mounting device so that the extension 316 can be closed over the top edge 100*a* of the blind 100 and the VELCRO™ strip 313 can be connected to the VELCRO™ strip 312. There is a hole 320, through which the ring 114 can be slid through so that the ring 114 may remain connected to the blind 100. There is another hole 322 at the back of the blind 300. The ring 114 may pass through holes 320 and 322 when the extension 316 is closed so that VELCRO™ strip 313 is connected to VELCRO™ strip 312.

Figure 10:
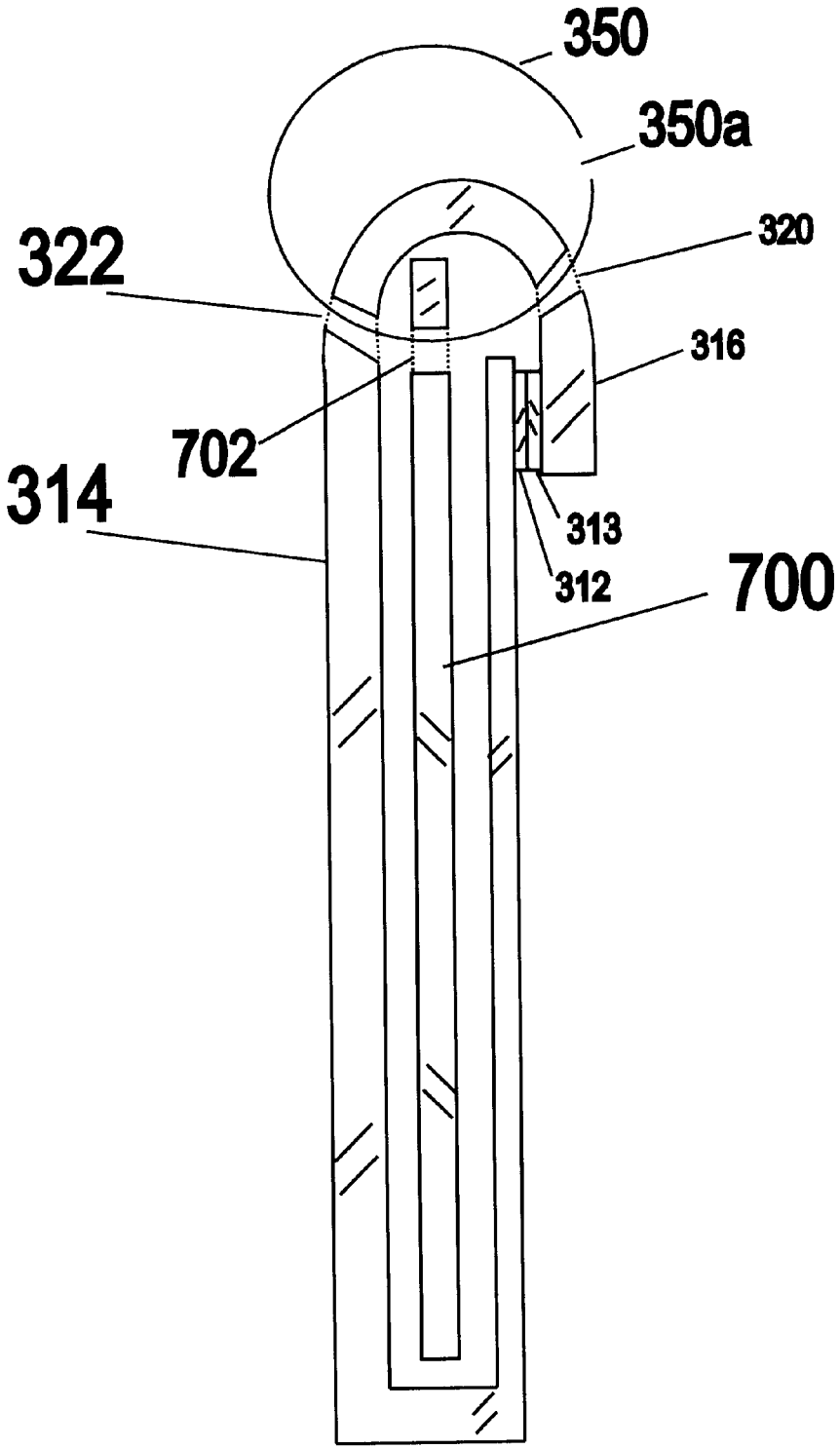
FIG. 10 shows a cross sectional view of a blind inside the sleeve of the embodiment of FIG. 6.

FIG. 10 shows a cross sectional view (dimensions not to scale) of the embodiment of FIG. 6 with the extension 316 closed so that the VELCRO™ strip 313 is connected to the VELCRO™ strip 312. A ring or hook 350 passes through the holes 322 and 320. FIG. 10 also shows a blind 700 which has a hole 702 through which the ring or hook 350 also passes. The ring or hook 350 can connect to hardware for blinds in a known manner. FIG. 10 shows the connection of VELCRO™ portion 312 to material 314 and the connection of VELCRO™ portion 313 to extension 316.

Figure 7:
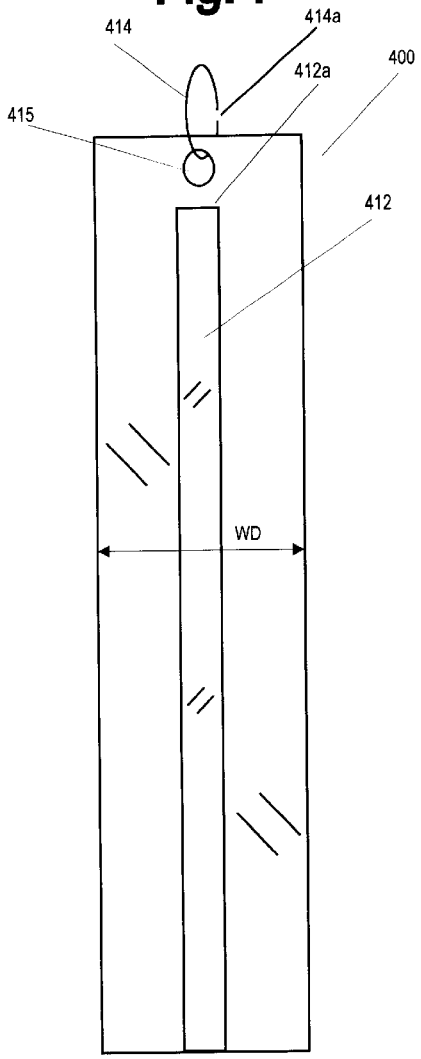
FIG. 7 shows a vertical blind with a strip of VELCRO™ running down the middle of the blind.

FIG. 7 shows another embodiment which shows a vertical blind 400 with a vertical strip of a VELCRO™ portion 412 (which may be either hooks or loops i.e. one part of a VELCRO™ system) running down the middle of the blind 400. The VELCRO™ strip portion 412 has an edge 412*a* which lies below a circular hole 415 for a ring 414. The ring 414 may have a gap 414*a* for inserting the ring through the circular hole 415.

Figure 8:
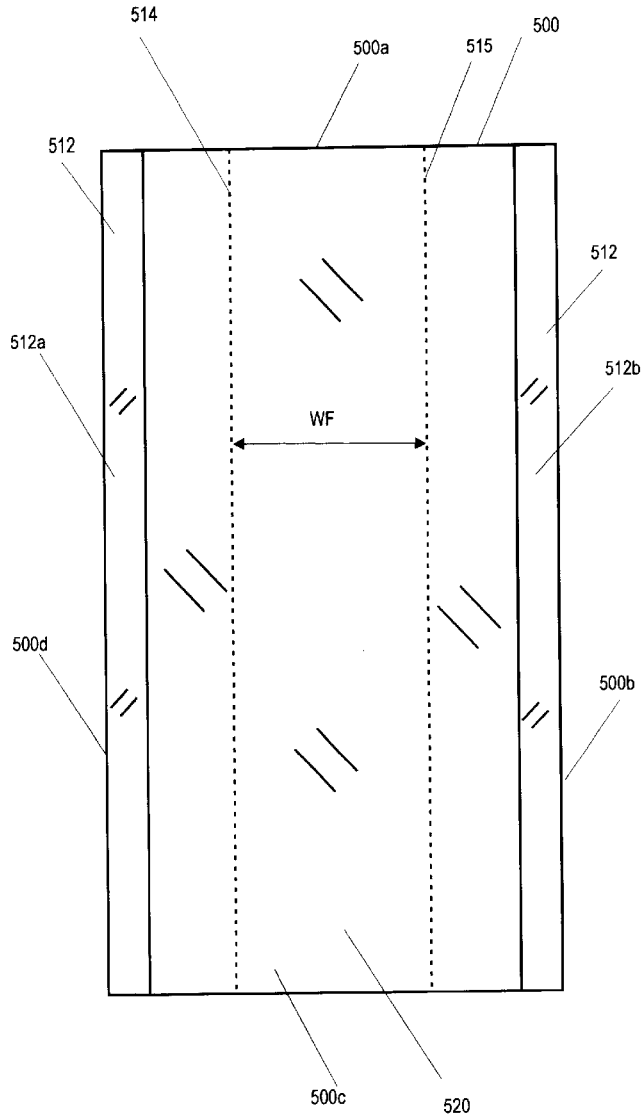
FIG. 8 shows another embodiment of the present invention where a strip of cloth is used to FIG. 9 shows the strip of cloth with VELCRO™ of FIG. 8 covering the FIG. 7 blind.

FIG. 8 shows a strip of cloth with VELCRO™ portion 500 which can be used to cover the vertical blind 400 of FIG. 7. The strip of cloth with VELCRO™ portion 500 includes material 520 and VELCRO™ portion 512. VELCRO™ portion 512 includes portions 512*a* and 512*b*. The VELCRO™ portions 512*a* and 512*b* are preferably both hooks or both loops. The strip of cloth with VELCRO™ portion 500 includes folds 514 and 515. The width WF between the folds 514 and 515 is about the same as the width WB of the vertical blind 400. The width WF can actually be slightly larger than WB to provide a snug fit.

Figure 9:
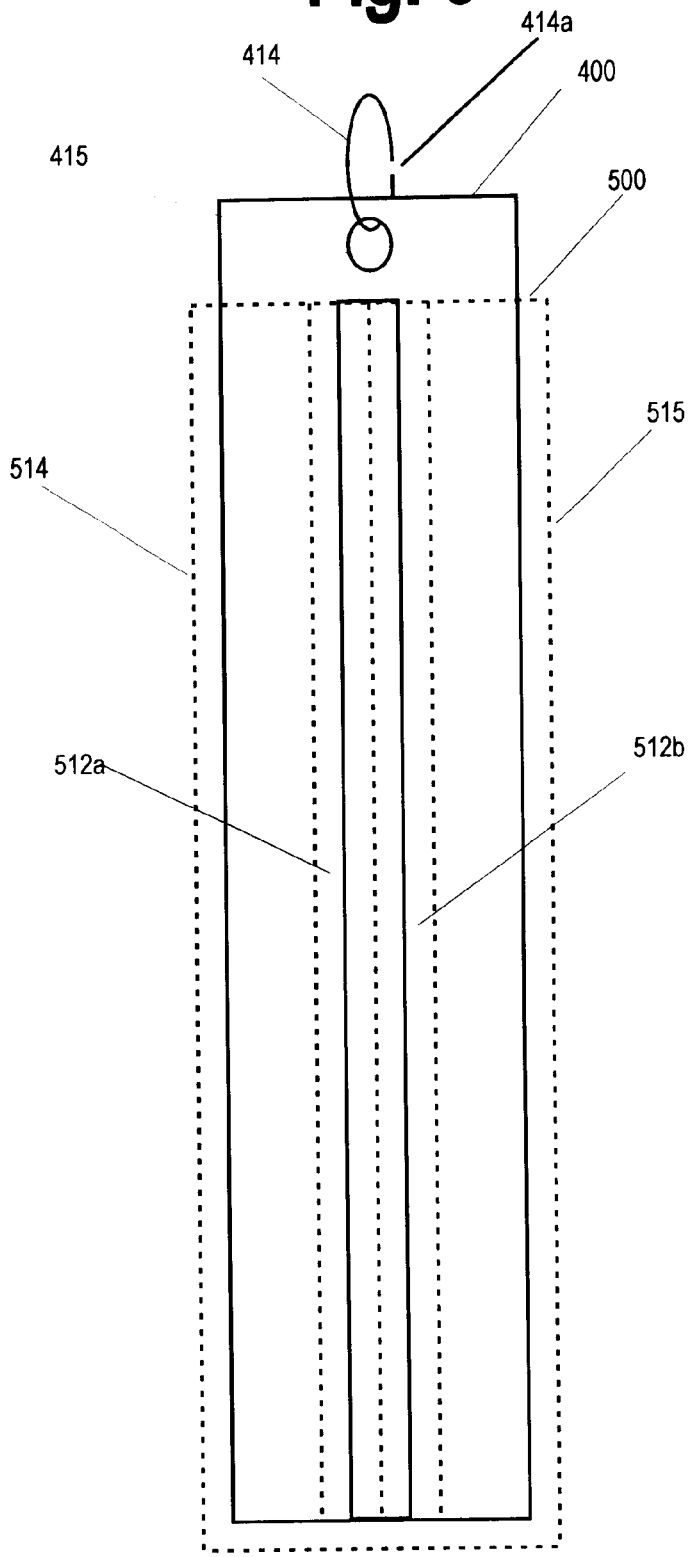

As shown in FIG. 9, one would fold the cloth with VELCRO™ portion 500 over the blind 400 so that the VELCRO™ portion 512*a* and 512*b* connect to the strip of VELCRO™ portion 412 on the blind 412. Again the VELCRO™ portion 512 may be only "hooks" and the VELCRO™ portion 412 may be only "loops" or vice versa.

The cloth 520 may be hemmed on all four sides prior to attaching the VELCRO™ 512*a* and 512*b* to it, in order to provide a neat appearance.

FIG. 10 shows a cross sectional view of a blind 700 inside the sleeve 300 of the embodiment of FIG. 6. The drawing of FIG. 10 is not to scale. The ring 350 is shown passing through the holes 322 and 320 of the sleeve 300. The ring 350 may have a gap 350*a* for inserting into the holes 322, 320, and 702. The extension 316 is shown in a closed position so that the VELCRO™ portion 313 (for example "hooks") on the extension 316 is shown attached to the VELCRO™ portion 312 (for example "loops") on the material 314. The ring 350 also passes through an opening 702 in the blind 700. The ring 250 may be suspended from vertical blind hardware not shown.

Figure 11:
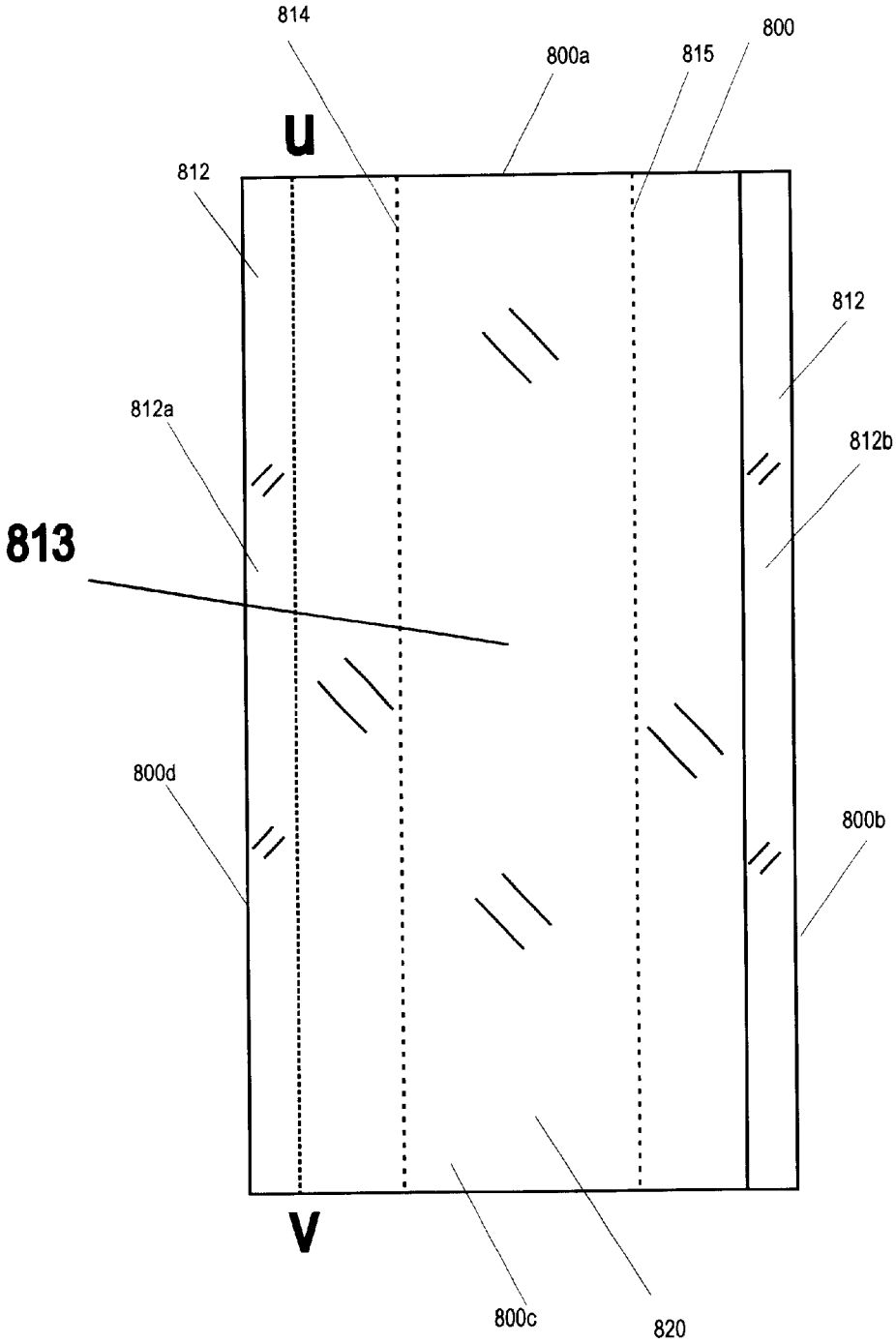
FIG. 11 shows another embodiment of the present invention wherein there is no need for any VELCRO™ portion to be included on the blind itself.
Figure 12:
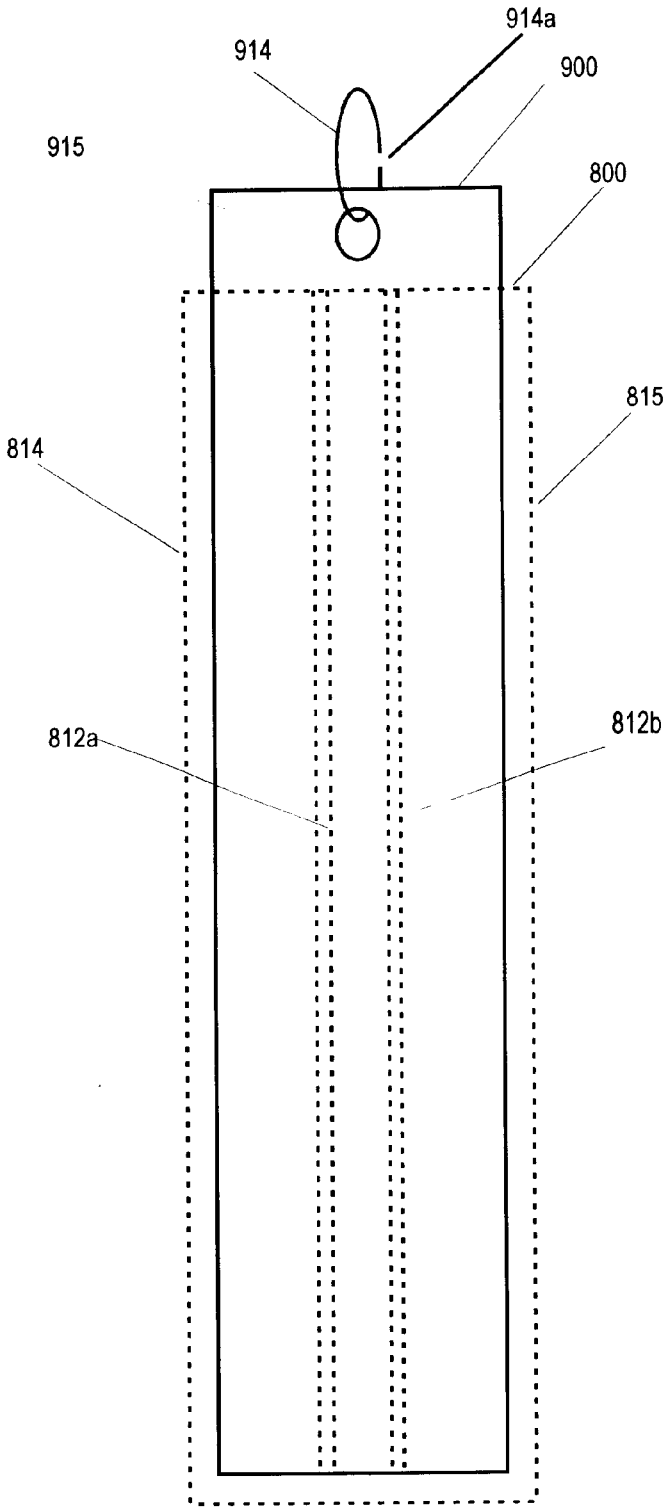
FIG. 12 shows a front view of another vertical blind and a strip of cloth in accordance with the present invention.

FIG. 11 shows a strip of cloth with VELCRO™ portions 800 which can be used to cover a vertical blind 900 as shown in FIG. 12. The vertical blind 900 may have a hole 915 for inserting into a ring 914 having a gap 914*a*. There does not need to be VELCRO™ on the vertical blind 900 in this embodiment. This is accomplished by providing a first VELCRO™ portion 812*a* (for example hooks) and a second VELCRO™ portion 812*b* (for example loops) on the strip of cloth with VELCRO™ portions 800. FIG. 11 shows one side 813 of the strip of cloth 800. In the FIG. 11 embodiment the second VELCRO™ portion 812*b* is on the side 813 while the first VELCRO™ portion is on the other side of the strip of cloth 800. For that reason the portion 812*a* is delineated by dashed line uv to show that the portion 812*a* is on the side of the page. As shown in FIG. 12 the strip of cloth 800 is folded over and the portion 812*b* is placed on top of portion 812*a*. The portion 812*b* is facing down into the page of FIG. 12 and the portion 812*a* is facing up out from the page of FIG. 12. The portions 812*a* and 812*b* may be of the same dimensions or the facing downwards portion 812*b* may larger and capable of completely covering portion 812*a*. In this way one cannot see any VELCRO™ when the portions 812*a* and 812*b* are properly attached to one another. When the portions 812*a* and 812*b* are attached to one another preferably there is a tight snug fit so that the folded over strip of cloth 800 stays fixed to the blind 900.

I claim:

1. An apparatus comprising a cover for covering a window blind;

a first attachment device fixed to the cover, the first attachment device adaptable for attaching to a second attachment device located on a window blind to cause the cover to become attached to the window blind and to cause the cover to substantially cover the window blind;

wherein the first attachment device is detachable from the second attachment device; to remove the cover from the window blind; and wherein the cover is shaped substantially in the form of a sleeve having a top, bottom and two sides;

the window blind is a vertical window blind having a top edge;

the sleeve is substantially closed on the bottom and on the two sides and having an opening at the top;

and wherein the first attachment device attaches to the second attachment device below the top edge of the window blind.

2. The apparatus of claim 1 wherein the first attachment device is located near the top of the sleeve.

3. The apparatus of claim 1 further comprised of the vertical window blind and the second attachment device.

4. The apparatus of claim 3 wherein the vertical window blind is substantially rectangular having a top, a bottom and two sides, the top being where the vertical blind connects to a suspension device; and the second attachment device is fixed to the vertical window blind near the top of the vertical window blind.

5. An apparatus comprising a cover for covering a window blind;

a first attachment device fixed to the cover, the first attachment device adaptable for attaching to a second attachment device located on a window blind to cause the cover to become attached to the window blind and to cause the cover to substantially cover the window blind;

wherein the first attachment device is detachable from the second attachment device; to remove the cover from the window blind;

wherein the cover is shaped substantially in the form of a sleeve having a top, bottom and two sides;

the window blind is a vertical window blind;

the sleeve is substantially closed on the bottom and on the two sides and having an opening at the top; and wherein the first attachment device is comprised substantially of a ring of material.

6. The apparatus of claim 5 wherein the first attachment device is comprised of a first portion of a hooks and loops fastener system and the second attachment device on the vertical blind is comprised of a second portion of a hooks and loops fastener system, where the first and second portions of the hooks and loops fastener system when pressed together attach the sleeve to the vertical blind.

7. The apparatus of claim 5 wherein the first attachment device is located near the top of the sleeve.

8. The apparatus of claim 7 wherein the first attachment device is comprised of a first portion of a hooks and loops fastener system and the second attachment device on the vertical blind is comprised of a second portion of a hooks and loops fastener system, where the first and second portions of the hooks and loops fastener system when pressed together attach the sleeve to the vertical blind.

9. An apparatus comprising a cover for covering a window blind;

a first attachment device fixed to the cover, the first attachment device adaptable for attaching to a second attachment device located on a window blind to cause the cover to become attached to the window blind and to cause the cover to substantially cover the window blind;

wherein the first attachment device is detachable from the second attachment device; to remove the cover from the window blind; and wherein the cover is shaped substantially in the form of a sleeve having a top, bottom and two sides;

the window blind is a vertical window blind;

the sleeve is substantially closed on the bottom and on the two sides and having an opening at the top; and wherein the first attachment device is comprised of a first portion of a hooks and loops fastener system and the second attachment device on the vertical blind is comprised of a second portion of a hooks and loops fastener system, where the first and second portions of the hooks and loops fastener system when pressed together attach the sleeve to the vertical blind.

10. An apparatus comprising a cover for covering a window blind;

a first attachment device fixed to the cover, the first attachment device adaptable for attaching to a second attachment device located on a window blind to cause the cover to become attached to the window blind and to cause the cover to substantially cover the window blind;

wherein the first attachment device is detachable from the second attachment device; to remove the cover from the window blind; and wherein the cover is shaped substantially in the form of a sleeve having a top, bottom and two sides;

the window blind is a vertical window blind;

the sleeve is substantially closed on the bottom and on the two sides and having an opening at the top;

wherein the first attachment device is located near the top of the sleeve; and wherein the first attachment device is comprised of a first portion of a hooks and loops fastener system and the second attachment device on the vertical blind is comprised of a second portion of a hooks and loops fastener system, where the first and second portions of the hooks and loops fastener system when pressed together attach the sleeve to the vertical blind.

11. An apparatus comprising a window blind;

a cover for covering the window blind;

a first attachment device fixed to the cover, the first attachment device adaptable for attaching to a second attachment device located on the window blind to cause the cover to become attached to the window blind and to cause the cover to substantially cover the window blind;

wherein the first attachment device is detachable from the second attachment device; to remove the cover from the window blind; and wherein the cover is shaped substantially in the form of a sleeve having a top, bottom and two sides;

the window blind is a vertical window blind;

the sleeve is substantially closed on the bottom and on the two sides and having an opening at the top; and wherein the first attachment device is comprised of a first portion of a hooks and loops fastener system and the second attachment device on the vertical blind is comprised of a second portion of a hooks and loops fastener system, where the first and second portions of the hooks and loops fastener system when pressed together attach the sleeve to the vertical blind.

12. An apparatus comprising a window blind;

a cover for covering the window blind;

a first attachment device fixed to the cover, the first attachment device adaptable for attaching to a second attachment device located on the window blind to cause the cover to become attached to the window blind and to cause the cover to substantially cover the window blind;

wherein the first attachment device is detachable from the second attachment device; to remove the cover from the window blind; and wherein the cover is shaped substantially in the form of a sleeve having a top, bottom and two sides;

the window blind is a vertical window blind;

the sleeve is substantially closed on the bottom and on the two sides and having an opening at the top;

wherein the vertical window blind is substantially rectangular having a top, a bottom and two sides, the top being where the vertical blind connects to a suspension device;

the second attachment device is fixed to the vertical window blind near the top of the vertical window blind;

wherein the first attachment device is comprised of a first portion of a hooks and loops fastener system and the second attachment device on the vertical blind is comprised of a second portion of a hooks and loops fastener system, where the first and second portions of the hooks and loops fastener system when pressed together attach the sleeve to the vertical blind.

13. An apparatus comprising a cover for covering a window blind;

a first attachment device fixed to the cover, the first attachment device adaptable for attaching to a second attachment device located on a window blind to cause the cover to become attached to the window blind and to cause the cover to substantially cover the window blind;

wherein the first attachment device is detachable from the second attachment device; to remove the cover from the window blind;

wherein the cover is substantially in the form of a rectangular material having a top, bottom, and two sides;

wherein the first attachment device is comprised of first and second portions, the first portion fixed to the cover near its first side and the second portion fixed to the cover near its second side.

14. The apparatus of claim 13 wherein the first portion and the second portion of the first attachment device make up a first part of a hooks and loops fastener system and the second attachment device on the blind makes up a second part of a hooks and loops fastener system, where the first and second parts of the hooks and loops fastener system when pressed together attach the cover to the blind.

15. The apparatus of claim 13 wherein the blind is a vertical blind having a top, bottom, and two sides; and wherein the second attachment device is an elongated strip fixed to the vertical blind so that the elongated strip runs from about the top of the vertical blind to about the bottom of the vertical blind and lies substantially in the middle of the vertical blind.

16. The apparatus of claim 15 wherein the first portion and the second portion of the first attachment device make up a first part of a velcro system and the second attachment device on the blind makes up a second part of a velcro system, where the first and second parts of the velcro system when pressed together attach the cover to the blind.

17. A method comprised of the steps of:

fixing a first attachment device to a substantially rectangular piece of material;

folding the rectangular piece of material, so that a first portion of the rectangular piece of material lies on top of a second portion of the rectangular piece of material;

sewing along a plurality of lines to connect the first portion of the rectangular piece of material to the second portion of the rectangular piece of material at a plurality of locations;

cutting the rectangular piece of material in between the sewed lines two form a plurality of sleeves; and wherein each sleeve comprised of a top, bottom, and two sides, wherein the sleeve is substantially closed at the bottom and the two sides and the sleeve has an opening at the top.

18. The method of claim 17 wherein the first attachment device is comprised of a portion of a hooks and loops fastener system.

19. The method of claim 17 further comprised of taking a sleeve and attaching it to a blind.

* * * * *